United States Patent [19]

Rauch

[11] 4,372,115

[45] Feb. 8, 1983

[54] OIL BACKED STIRLING ENGINE DISPLACER DIAPHRAGM

[75] Inventor: Jeffrey S. Rauch, Albany, N.Y.

[73] Assignee: Mechanical Technology Incorporated, Latham, N.Y.

[21] Appl. No.: 270,974

[22] Filed: Jun. 5, 1981

[51] Int. Cl.[3] ..... F02G 1/04

[52] U.S. Cl. ..... 60/520; 60/517

[58] Field of Search ..... 60/517, 520; 62/6

[56] References Cited

U.S. PATENT DOCUMENTS

| | | | |
|---|---|---|---|
| Re. 29,518 | 1/1978 | Franklin | 60/520 |
| 2,611,236 | 9/1952 | Kohler et al. | 60/24 |
| 3,400,281 | 9/1968 | Malik | 310/2 |
| 3,530,681 | 9/1970 | Dehne | 62/6 |
| 3,548,589 | 12/1970 | Cooke-Yarborough | 60/24 |
| 3,604,821 | 9/1971 | Martini | 417/379 |
| 3,645,649 | 2/1972 | Beale | 62/6 X |
| 3,805,527 | 4/1974 | Cooke-Yarborough et al. | 60/517 |
| 3,822,388 | 7/1974 | Martini et al. | 310/2 |
| 3,827,675 | 8/1974 | Schuman | 356/85 |
| 3,949,554 | 4/1976 | Noble et al. | 60/521 |

FOREIGN PATENT DOCUMENTS 1539034 1/1979 United Kingdom .

OTHER PUBLICATIONS

Report No. NO1-HV-42901-6, to National Heart and Lung Institute Contract No. NO1-HV-4-2901, R. P. Johnston et al., Aug. 1979.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A free piston Stirling engine having a free displacer mounted in a sealed vessel and suspended on a diaphragm. A rigid wall on the displacer forms, with the diaphragm, a closed oil cavity. A moving wall such as a piston or bellows in the rigid wall accommodates volmetric changes in the cavity when the displacer oscillates in the engine working space to control pressure induced stresses in the diaphragm.

15 Claims, 3 Drawing Figures

Fig. 2
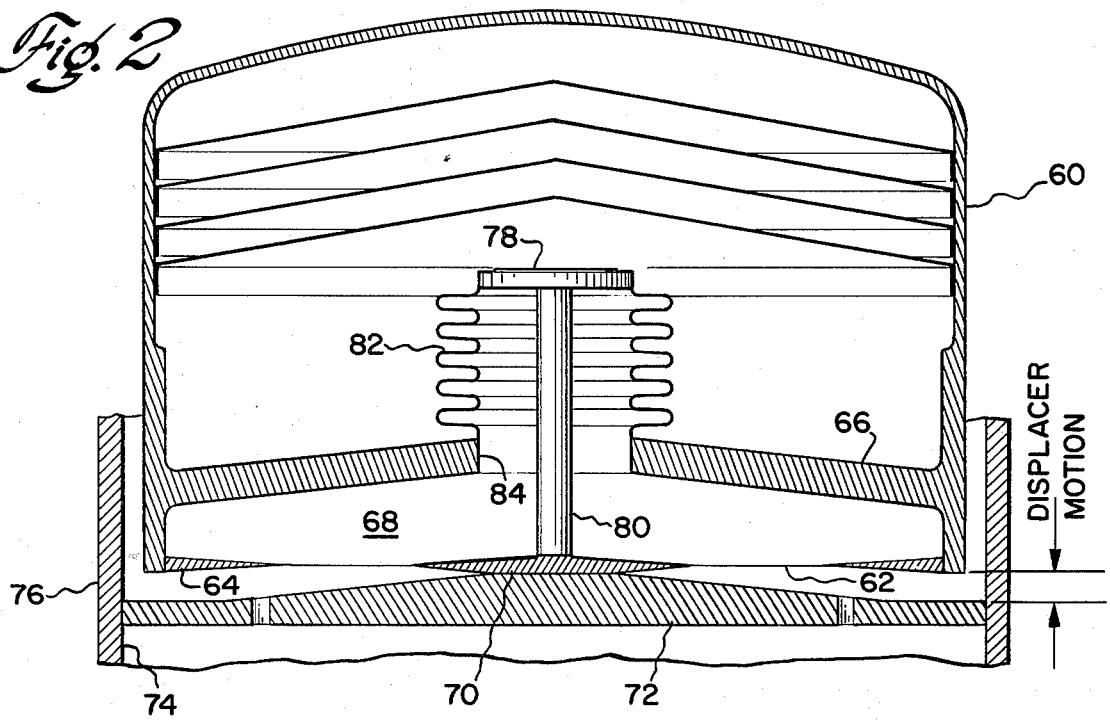
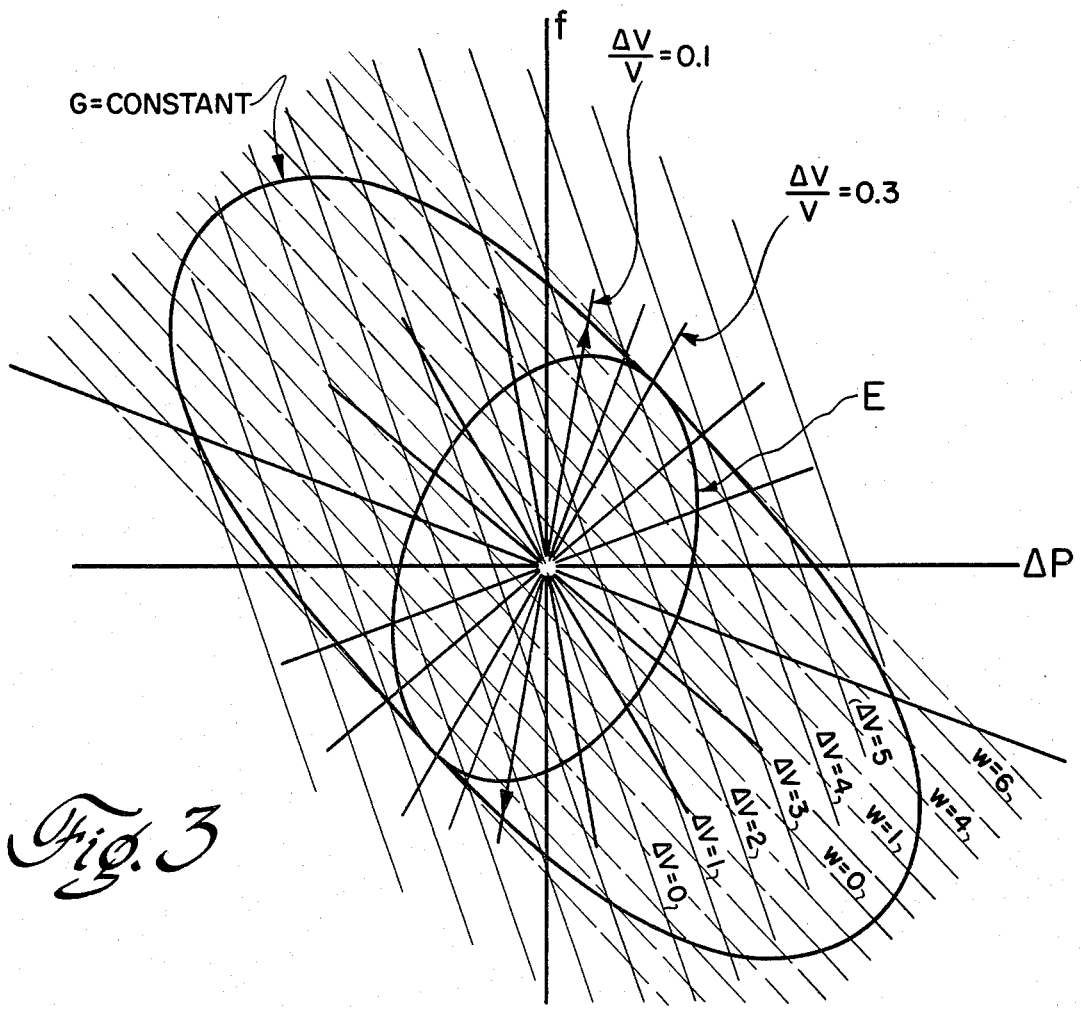
Fig. 3

OIL BACKED STIRLING ENGINE DISPLACER DIAPHRAGM

BACKGROUND OF THE INVENTION

This invention relates to free piston Stirling engines, and more particularly to an oil backed diaphragm for suspending a free displacer in a free piston Stirling engine.

This invention is related to application Ser. No. 172,373 for "Diaphragm Displacer Stirling Engine Powered Alternator-Compressor," filed on July 25, 1980, by Folsom, et al., the disclosure which is incorporated herein by reference. The engine of this application Ser. No. 172,373 is a free piston Stirling engine which utilizes a diaphragm to suspend the displacer in the working space and uses the pressure wave in the working space to maintain the displacer oscillation. Although this machine constitutes a significant step forward in the art, there are some areas in which modifications would improve reliability, performance, and power density.

In the machine of application Ser. No. 172,373, the displacer diaphragm is subjected to stress induced by the pressure swing of the working gas in the working space which is on the order of 10 to 20 percent of the charge pressure in the working space, or about 40 bar. Therefore, the pressure swing can be on the order of 4 to 8 bar which, acting over the full face of the diaphragm, can introduce considerable stress in the diaphragm. This complicates the deformation pattern of the diaphragm and reduces its working life. This pressure induced stress does not contribute to the operation of the machine. The only stress that is desirable from the design function is displacement induced stress, that is, the spring effect contributed by the diaphragm when it is displaced from its central position. This necessary and desirable stress in the diaphragm is compounded and multiplied in unpredictable ways and with deleterious results by the pressure induced stresses in the diaphragm so that the diaphragm design is greatly complicated and diaphragm reliability and repeatability is decreased. Moreover, the effect changes with changing pressure and therefore an additional degree of difficulty is introduced when a power control system based on mean pressure variation is used.

A second area of improvement which would be desirable is control of the power input into the displacer itself. Power input into the displacer is related to the ratio $\Delta V/V$ where $\Delta V$ is the difference in the volumetric displacement of the displacer in the expansion space and the compression space, and V is the volumetric displacement of the displacer in the expansion space. The power needed to maintain the oscillation of the displacer in the working space, that is the power necessary to overcome the friction and windage losses of the working gas in the heat exchangers, normally requires a $\Delta V/V$ ratio of approximately 0.1. However, a diaphragm normally provides a $\Delta V/V$ in an engine of this variety of approximately 0.3, thus providing more energy for the displacer than it needs. This energy excess causes the displacer to slam back and forth between its stop unless some means is provided to extract the excess energy put into the diaphragm by its thermodynamic system, or some technique is provided for constraining the $\Delta V/V$ ratio to a value more suited to the engine operation.

Along these lines, it is possible by artful design of a displacer to enable it to operate with the characteristic desired, that is with a small $\Delta V$. However, although the diaphragm is capable of operating in this manner, there is no assurance that it will indeed operate in this manner when placed in an unconstrained manner in the engine and operated at various pressures and other operating parameters. Therefore, it is necessary to impose some form of restraint on the deformation pattern of the diaphragm in its operation so that it will conform to the desired configuration.

SUMMARY OF THE INVENTION

Accordingly, it is an object of this invention to provide a diaphragm displacer system for a free displacer in a free piston Stirling engine wherein the displacement volume produced by the deflection of the diaphragm is controlled. It is another object of this invention to isolate the displacer diaphragm from pressure induced stresses so that it is subjected only to displacement induced stress.

These and other objects of the invention are achieved in the preferred embodiments of the invention wherein the displacer end wall forms one side of a cavity, the other side of which is formed by the displacer diaphragm. A volume adjusting device is provided which controls the cavity volume so that the diaphragm volumetric displacement is controlled by the cavity volume adjusting device. The stresses in the diaphragm are thus restricted to the displacement induced stresses only and pressure effects are transmitted through the diaphragm and the liquid in the cavity to the displacer end wall and therefore the diaphragm is substantially free of pressure induced stresses.

DESCRIPTION OF THE DRAWINGS

The invention and its many attendant objects and advantages will become better understood by reading the following description of the preferred embodiments in conjunction with the following drawings, wherein:

FIG. 2 is a sectional elevation of a second embodiment of a diaphragm mounted displacer according to this invention; and FIG. 3 is a graph showing the relationship of various parameters in the operation of a free piston Stirling engine having a diaphragm mounted displacer.

DESCRIPTION OF THE PREFERRED EMBODIMENTS

Figure 1:
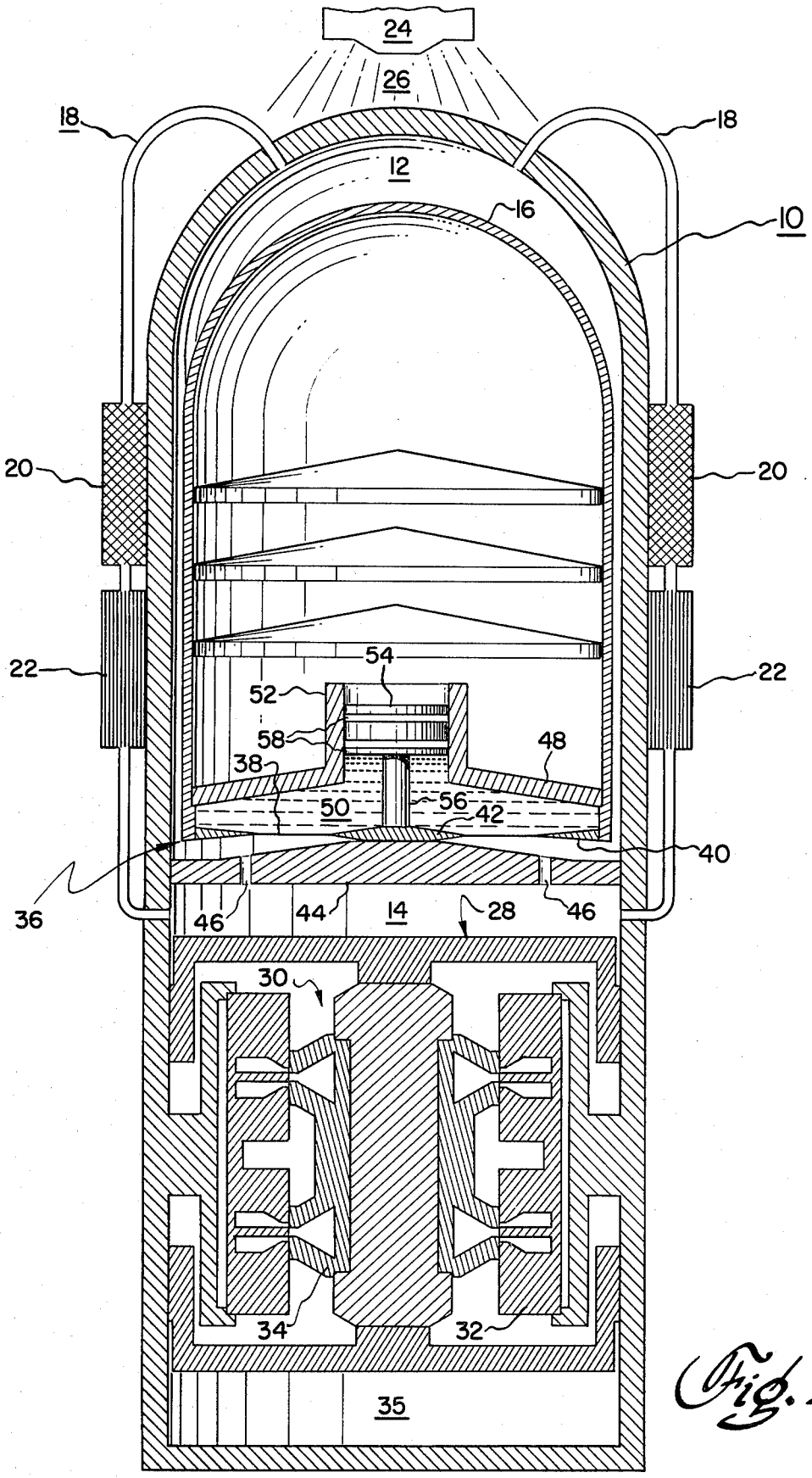
FIG. 1 is a schematic elevation of a free piston Stirling engine incorporating a diaphragm mounted displacer according to this invention.

Referring now to the drawings, wherein like reference characters designate identical parts, and more particularly to FIG. 1 thereof, a free piston Stirling engine is shown having a hermetically sealed vessel 10 enclosing a working space having an expansion volume 12 and a compression volume 14 between which a displacer 16 oscillates. The oscillation of the displacer causes working gas to circulate back and forth cyclically through a heater 18, a regenerator 20, and a cooler 22. The heater 18 is heated by combustion gases from a combustor 24 which burns liquid or gaseous fuel in a combustor space 26, and the cooler is cooled by a circulating coolant such as water or liquid freon.

The lower surface of the compression space 14 is defined by the top face of a power piston 28 which produces output power, in this case in the form of electrical power from a linear alternator 30. The alternator includes a stator 32 fixed to the interior wall of the vessel 10 and a plunger 34 which reciprocates opposite the stator 32 to switch the flux in the stator and induce electrical power in a manner taught in U.S. Pat. No. 3,981,874 to Rotors et al.

A pressure wave is generated in the working gas in the working space when the displacer 16 oscillates. This pressure wave is caused by cyclic changes in the temperature of the confined charge of working gas as it passes through the heat exchangers. That is, as the displacer moves upwardly into the expansion volume 12, it displaces working gas from the expansion volume through the heater 18 and into the regenerator 20 where the heat from the working gas is deposited. Then, the gas flows into the cooler 22 where it is cooled before flowing into the compression space 14. In the compression space, the working gas is compressed in a cold state by the upwardly moving piston 28 in the isothermal compression phase of the Stirling cycle. The displacer 16, which at this point is at its uppermost position in the working space, then begins to move downwardly, displacing cold compressed working gas from the compression space 14 back through the cooler 22 and the regenerator 20 where it picks up the heat which it deposited on the previous pass, and then flows into the heater 18 where it is raised to the design high temperature. The high temperature gas then expands into the expansion space 12 against the piston 28, driving it downwardly to produce an output power stroke. The downwardly moving piston compresses gas in a bounce space 35 which acts as a gas spring to drive the piston 28 back upwardly on the compression stroke.

The displacer motion is maintained by the diaphragm system 36 of this invention. The diaphragm system 36 is mounted at the lower or cold end of the displacer 16 and provides the mounting suspension for radial and axial support of the displacer in the working space. It also provides the means for deriving sufficient work from the work gas pressure wave in the working space to overcome the viscous and friction losses of the oscillating displacer in the working space. The third function of the diaphragm system is to provide a spring effect so that the displacer is returned toward its mid-stroke position after it is displaced by the working gas pressure wave.

The diaphragm support system 36 includes a diaphragm 38 connected at its outer peripheral edge 40 to the lower inner peripheral edge of the displacer 16. The diaphragm 38 is connected at its center 42 to a partition 44 rigidly mounted at its outer edge to the vessel 10. A series of holes 46 are formed through the partition 44 to communicate the gas pressure in the compression space 14 to the undersurface of the diaphragm 38.

A rigid end wall 48 is attached to the lower end of the displacer 16 adjacent the outer edge 40 of the diaphragm 38. A cavity 50 is defined between the diaphragm 38 and the rigid wall 48 which constitutes a solid backing or bounding member. The cavity 50 is filled with an incompressible liquid such as hydraulic fluid which transmits pressure forces exerted on the diaphragm to the rigid wall 48 and thence to the displacer.

The volumetric displacement of the diaphragm 38 in the cavity is accommodated, and the cavity volume is controlled by a volume accommodating and control system which includes an upstanding cylinder 52 formed coaxially on the rigid wall 48 and receiving an element such as a piston 54 axially fixed to the partition 44 by a post 56. A set of piston rings 58 is mounted on the piston 54 to prevent leakage of hydraulic fluid from the cavity 50 between the cylinder 52 and piston 54.

In operation, the diaphragm 38 is subjected to displacement induced stresses when the displacer moves from the mid-stroke position illustrated in FIG. 1. These stresses are stored as spring forces which tend to return the displacer toward the mid-stroke position when it is displaced upward or downward from the mid-stroke position.

The diaphragm is also subjected to gas pressure forces from the pressure wave in the working space. These pressure forces, if unrestrained, would tend to distort the diaphragm. For this reason, the volume of the cavity 50 is controlled by the piston 54 which acts as a movable wall in the cylinder 52. The piston 54 is actually stationary with respect to the vessel 10 and the cylinder 52 moves with respect to the stationary piston 54. The diameter of the piston is selected so that the cavity volume change produced by the displacement of the diaphragm 38 toward or away from the rigid wall 48 is just compensated by a volumetric change in the cavity produced by movement of the cylinder 52 with respect to the piston 54.

The configuration of the diaphragm 38 is selected to produce maximum deflection near the center of the diaphragm so that the volume swept by the diaphragm is about 90% of the volume swept by the top end of the displacer 16. This produces a $\Delta V/V$ ratio close to the desired value of about 0.1. However, the diaphragm, while designed to be capable of this pattern of deflection, is also capable of other deflection patterns which produce displacement values other than the designed value. Therefore, the diaphragm system 38 is designed to constrain the diaphragm 38 to deflect in the desired manner, and no other. This is achieved by regulating the internal volume of the cavity 50. Since the liquid in the cavity 50 is incompressible, the volumetric displacement of the diaphragm 38 must exactly equal the volumetric displacement of the piston 54 in the cylinder 52 when the displacer moves. In this manner, it is possible to precisely design the $\Delta V$ component of the $\Delta V/V$ ratio so that this ratio can correspond to the power requirements of the displacer.

Turning now to FIG. 2, a second embodiment of the invention is shown having a displacer shell 60 whose lower end has mounted thereon a diaphragm 62 having an outer peripheral edge 64 welded to the lower peripheral edge of the displacer shell 60. A rigid end wall 66 is connected to the displacer shell 60 above the diaphragm 62 and forms, with the diaphragm, a cavity 68 filled with incompressible liquid such as hydraulic fluid. The diaphragm 62 is connected at its center 70 to an internal rigid partition 72 fastened to the interior wall 74 of a hermetically sealed vessel like the vessel 10 in the embodiment of FIG. 1, a portion of which is shown at 76.

An element such as a disc 78 is mounted to the top of a post 80 which fixes the disc 78 axially with respect to the vessel 76. The post 80 is mounted on the center of the rigid partition 72. A bellows 82 is mounted between the outer peripheral edge of the disc 78 and the edge of an axial hole 84 formed through the rigid wall 66 so that the liquid pressure in the liquid cavity 68 is exerted against the underside of the disc 78 and is confined within the cavity 68 by the bellows 82. In this manner, displacement of the displacer shell 60 causes a displacement of the diaphragm 62 and a corresponding displacement of the rigid wall 66 with respect to the disc 78 so that the volumetric displacement in the cavity 68 caused by the flexing of the diaphragm 62 is accommodated by the volumetric displacement of the rigid wall 66 relative to the disc 78. The control of the cavity volume prevents excessive pressure induced stresses from occurring in the diaphragm 62 so that the diaphragm stress is maintained within the desired limits.

Turning now to FIG. 3, the characteristics of a diaphragm are shown on a graph having $\Delta P$ as the abscissa and the displacement force f as the ordinate. The force f is the force exerted on the diaphragm by the partition 44 at its connection to the center 42 of the diaphragm. In the sign convention of FIG. 3, this force is positive when the displacer is below its center position and negative when the displacer is above its center position.

The pressure drop $\Delta P$ across the diaphragm, in a gas-backed diaphragm, is the difference between the engine charge pressure and the instantaneous working gas pressure in the working space. The working gas pressure in a free piston Stirling engine usually lags the displacer displacement and hence the force f by about 70°. Hence, in a gas-backed diaphragm, the force f leads the pressure $\Delta P$ by about 60°–70° and it is possible to plot the curve on the $f/\Delta P$ graph of the pressure and force acting on the diaphragm. It results in a closed elliptical curve E whose main axis lies at about 60°–70°.

The other parameters appear on this graph as families of straight lines. The diaphragm displacement w and the volume differential $\Delta V$ in a gas-backed diaphragm are at the intersection of the closed curve E with these families of straight lines. The ratios $\Delta V/V$, which are represented by a family of radial lines, can also be found at their intersection with the closed curve. The maximum designed stress level for the diaphragm is shown on the curve G. To avoid exceeding this stress level and overstressing the diaphragm, the operating curve E must be confined within the curve G.

A major advantage of the oil-backed diaphragm of this invention is the control it affords over the ratio $\Delta V/V$, where $\Delta V$ is the diaphragm displacement volume, and $V=A_d\Delta w$, which is the swept area of the displacer in the expansion space. Without this control, the diaphragm operating curve E freely follows the f and $\Delta P$ points established by the working gas pressure wave in the engine working space, and the $\Delta V/V$ values are determined by this curve. In this invention, the diaphragm is constrained to operate on a line of equal $\Delta V/V$, and this line is selected to produce the optimum energy point into the displacer. Serendipitously, the advantageous $\Delta V/V$ line corresponding to a value of about 0.1 also can be arranged to intersect a maximum number of w lines while remaining within the curve G that represents the locus of maximum permissible stress points and remaining close to the f ordinate to minimize the $\Delta P$ across the diaphragm. It is thus possible to design the diaphragm to produce the desired characteristics while staying well clear of the maximum allowable stress limits.

The invention thus enables a diaphragm mounted displacer in a free piston Stirling engine to operate reliably and with the optimum level of power supplied to maintain the displace motion. The diaphragm life is extended by controlling pressure induced stress. The displacement pattern is constrained to a particular form that maintains a wide margin of safety from the maximum stress level. The displacer diaphragm is unaffected by changes in engine charge pressure or frequency, and displacer phase and stroke can be regulated in conventional ways.

Obviously, numerous modifications and variations of the preferred embodiment will occur to those skilled in the art in view of this disclosure. Therefore, it is expressly to be understood that these modifications and variations and the equivalence thereof, may be practiced while remaining within the spirit and scope of the invention as defined in the following claims, wherein

I claim:

1. In a free piston Stirling engine having a vessel defining therein a working space in which oscillates a displacer, and a flexible diaphragm connected between said vessel and said displacer, wherein the improvement comprises:

a liquid cavity having two sides and bounded on one of said sides by said diaphragm, and bounded on the other of said sides by a bounding member; and means for accommodating the volumetric changes caused by the deflection of said diaphragm into and out of said cavity when said displacer oscillates;

whereby pressure in said working space is transmitted through said diaphragm and the liquid in said cavity to said bounding member so that pressure stresses in said diaphragm are reduced.

2. The engine defined in claim 1, wherein said volumetric change accommodating means includes an element axially fixed to said vessel and movably sealed to said bounding member, whereby the volume in said cavity remains substantially equal at all displacements of said displacer so the only substantial stress in said diaphragm is displacement induced stress.

3. The engine defined in claim 1, wherein said accommodating means allows volumetric changes in said cavity to the extent of the deflection of said diaphragm caused by displacement of said displacer only, so that pressure exerted on said diaphragm by said working gas causes no deflection of said diaphragm independent of that caused by displacement of said displacer.

4. The engine defined in claim 3 wherein said accommodating means includes a piston attached to said vessel and stationary with respect thereto, and a cylinder formed in said bounding member; said cylinder receiving said piston and moving with respect thereto when said displacer moves to cause a volumetric change in said cavity corresponding to the volumetric change caused by displacement of said diaphragm.

5. A free piston Stirling engine having a vessel enclosing a working space, a displacer mounted in said working space for oscillation therein and for displacing a working gas in said working space through a heater, a regenerator, and a cooler to create a pressure wave that drives a power piston, wherein the improvement comprises:

means defining a cavity adapted to contain a liquid at one end of said displacer;

a displacer diaphragm attached to said vessel and sealing said cavity; and means in said cavity for applying the working gas pressure wave transmitted through said diaphragm and the liquid in said cavity to said displacer.

6. The engine defined in claim 5, further comprising means for controlling the volumetric displacement of said diaphragm when said displacer moves from its neutral position.

7. The engine defined in claim 6, wherein said cavity defining means includes a rigid wall attached to said displacer, and said controlling means includes a cylinder formed in said rigid wall and a piston disposed in said cylinder and fixed axially with respect to said vessel.

8. The engine defined in claim 7, wherein said diaphragm is thick at its center and outside edge, and tapers to an annular relatively thinner section intermediate the center and peripheral edges.

9. The engine defined in claim 6, wherein said cavity defining means includes a rigid wall connected across the displacer adjacent one end thereof, said rigid wall having an axial opening forming therethrough; and said controlling means includes a disc mounted in fixed position axially with respect to said vessel, and a bellows connected in fluid-tight relation to said disc and said rigid wall around said opening.

10. A free piston Stirling engine including a vessel defining therein a working space; a displacer mounted in said working space and supported for axial oscillation to displace working gas in said working space back and forth between an expansion space, a heater, a regenerator, a cooler, and a compression space for producing a pressure wave in said working gas that is converted by said engine to output power and maintains the oscillating motion of said displacer; wherein the improvement comprises:

a diaphragm fastened to said vessel in said working space and exposed on one face thereof to said pressure wave;

means for transmitting the pressure forces of said pressure wave through said diaphragm, substantially without deflection thereof, to said displacer;

said diaphragm deflecting upon displacement of said displacer and storing displacement force therein as displacement induced stress independent of and substantially free of pressure induced stress.

11. A free piston Stirling engine having a vessel enclosing a working space and adapted to contain a working gas under high pressure; and a displacer mounted in said working space for axial oscillation therein; wherein the improvement comprises:

means defining a cavity in one end of said displacer, adapted to contain an incompressible liquid, including a flexible wall sealing one side of said cavity and a rigid wall attached to said displacer forming a substantial portion of the opposite wall of said cavity;

said flexible wall including a diaphragm fastened to said vessel;

volume control means for maintaining the volume of said cavity substantially constant irrespective of working gas pressure changes within said working space, and changing the volume of one portion of said cavity by a value corresponding to a predetermined volumetric deflection of said diaphragm with respect to another portion of said cavity caused by displacement of said displacer; and means independent of said displacer diaphragm for absorbing the force exerted by the liquid in said cavity and transmitting said force to said displacer.

12. The engine defined in claim 11, wherein said volume control means includes a cylinder formed in said rigid wall, and a piston disposed in said cylinder and axially fixed with respect to said vessel, whereby axial oscillation of said displacer causes displacement of said piston in said cylinder for controlled volume changes in said one portion of said cavity and controlled displacement of said diaphragm.

13. The engine defined in claim 11, wherein said volume control means includes an element axially fixed with respect to said vessel; opening in said rigid wall; means forming a fluid-tight coupling between said element and said opening whereby axial motion of said displacer causes relative movement of said element and said opening for controlled change of said one portion of said cavity volume and controlled deflection of said diaphragm.

14. The engine defined in claim 13, wherein said element includes a disc connected to said vessel by a post extending into said cavity, and said fluid tight coupling includes a bellows connected between said disc and said rigid wall.

15. The engine defined in claim 13 wherein said element includes a piston; said opening includes a cylinder receiving said piston; and said fluid tight coupling includes a piston ring on said piston.

* * * * *